US011971172B2

(12) United States Patent
Lind et al.

(10) Patent No.: US 11,971,172 B2
(45) Date of Patent: Apr. 30, 2024

(54) COMBUSTOR PREMIXER ASSEMBLY INCLUDING INLET LIPS

(71) Applicant: General Electric Company, Schenectady, NY (US)

(72) Inventors: David A. Lind, Lebanon, OH (US); Ajoy Patra, Bengaluru (IN); Ting-Yu Tu, Cincinnati, OH (US); Pradeep Naik, Bengaluru (IN); Gregory A. Boardman, Owens Cross Road, AL (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 107 days.

(21) Appl. No.: 17/509,470

(22) Filed: Oct. 25, 2021

(65) Prior Publication Data

US 2022/0042683 A1 Feb. 10, 2022

Related U.S. Application Data

(62) Division of application No. 16/407,990, filed on May 9, 2019, now Pat. No. 11,175,046.

(51) Int. Cl.

| | |
|---|---|
| ***F23R 3/28*** | (2006.01) |
| ***F23R 3/14*** | (2006.01) |
| ***F23R 3/34*** | (2006.01) |
| *F23C 7/00* | (2006.01) |

(52) U.S. Cl.

CPC ..... *F23R 3/286* (2013.01); *F23R 3/14* (2013.01); *F23R 3/34* (2013.01); *F23C 7/004* (2013.01)

(58) Field of Classification Search

CPC .... F23R 3/286; F23R 3/14; F23R 3/34; F23C 7/004

See application file for complete search history.

(56) References Cited

U.S. PATENT DOCUMENTS

| | | | |
|---|---|---|---|
| 3,618,317 | A | 11/1971 | Du Bell |
| 3,667,221 | A | 6/1972 | Taylor |
| 3,906,718 | A | 9/1975 | Wood |
| 4,584,834 | A | 4/1986 | Koshoffer et al. |
| 5,237,820 | A | 8/1993 | Kastl et al. |
| 5,323,604 | A | 6/1994 | Ekstedt et al. |
| 5,511,375 | A | 4/1996 | Joshi et al. |
| 5,592,819 | A | 1/1997 | Ansart et al. |
| 5,630,319 | A | 5/1997 | Schilling et al. |
| 5,899,075 | A | 5/1999 | Dean et al. |
| 5,924,288 | A | 7/1999 | Fortuna et al. |
| 6,141,967 | A | 11/2000 | Angel et al. |
| 6,272,864 | B1 | 8/2001 | Keller |

(Continued)

FOREIGN PATENT DOCUMENTS

| | | | |
|---|---|---|---|
| CN | 107676815 | A | 2/2018 |
| CN | 108019776 | A | 5/2018 |
| JP | 2010197039 | A | 9/2010 |

*Primary Examiner* — Katheryn A Malatek
*Assistant Examiner* — Alyson Joan Harrington
(74) *Attorney, Agent, or Firm* — Venable LLP; Elizabeth C. G. Gitlin; Michele V. Frank

(57) ABSTRACT

A premixer assembly for a combustor includes: at least one ring of premixers, each premixer having a central axis, an annular peripheral wall surrounding a centerbody, and at least one swirler disposed between the centerbody and the peripheral wall, wherein the peripheral wall defines an inlet area of the premixer; and a lip extending forward along the central axis from the peripheral wall, the lip extending at an oblique angle to the axis of symmetry.

20 Claims, 6 Drawing Sheets

(56) References Cited

U.S. PATENT DOCUMENTS

| | | | |
|---|---|---|---|
| 6,272,865 | B1 | 8/2001 | Clark et al. |
| 6,415,594 | B1 | 7/2002 | Durbin et al. |
| 6,779,268 | B1 | 8/2004 | Farmer |
| 6,978,619 | B2 | 12/2005 | Blomeyer |
| 7,059,135 | B2 | 6/2006 | Held et al. |
| 7,222,488 | B2 | 5/2007 | Farmer et al. |
| 7,926,281 | B2 | 4/2011 | Commaret et al. |
| 8,365,531 | B2 | 2/2013 | Pidcock et al. |
| 8,943,829 | B2 | 2/2015 | Bagchi et al. |
| 10,161,634 | B2 | 12/2018 | Toon |

COMBUSTOR PREMIXER ASSEMBLY INCLUDING INLET LIPS

CROSS-REFERENCE TO RELATED APPLICATIONS

This application is a divisional of U.S. application Ser. No. 16/407,990, filed May 9, 2019, the content of which is hereby incorporated by reference in its entirety.

BACKGROUND OF THE INVENTION

The present invention relates generally to combustors, and more particularly to gas turbine engine combustor premixers.

A gas turbine engine typically includes, in serial flow communication, a low-pressure compressor or booster, a high-pressure compressor, a combustor, a high-pressure turbine, and a low-pressure turbine. The combustor generates combustion gases that are channeled in succession to the high-pressure turbine where they are expanded to drive the high-pressure turbine, and then to the low-pressure turbine where they are further expanded to drive the low-pressure turbine. The high-pressure turbine is drivingly connected to the high-pressure compressor via a first rotor shaft, and the low-pressure turbine is drivingly connected to the booster via a second rotor shaft.

One type of combustor known in the prior art includes an annular array of domes interconnecting the upstream ends of annular inner and outer liners. These may be arranged, for example, as "single annular combustors" having one ring of domes, "double annular combustors" having two rings of domes, or "triple annular" combustors having three rings of domes.

Typically, each dome is provided with a premixer cup (or simply "premixer"). The premixer cups are arranged in radially-adjacent annular rings.

One problem with such premixers is they have discrete blunt inlets which causes improper flow feed to premixer cups not well aligned with the diffuser discharge, resulting in poor total pressure recovery. Furthermore, blunt premixer inlets cause poor air flow feed to inner and outer combustor liner flow passages, resulting in poor back flow margins for the turbine nozzle cooling flows.

BRIEF DESCRIPTION OF THE INVENTION

This problem is addressed by a combustor premixer including one or more inlet lips adjacent or between premixers.

According to one aspect of the technology described herein, a premixer assembly for a combustor includes: at least one ring of premixers having a central axis, an annular peripheral wall surrounding a centerbody, and at least one swirler disposed between the centerbody and the peripheral wall, wherein the peripheral wall defines an inlet area of the premixer; and a lip extending forward along the central axis from the peripheral wall, the lip extending at an oblique angle to the central axis.

According to another aspect of the technology described herein a combustor for a gas turbine engine includes: an annular inner liner; an annular outer liner spaced apart from the inner liner; a domed end disposed at an upstream end of the inner and outer liners, the domed and including at least two concentric annular domes; each dome including an annular array of premixers, each premixer having a central axis, an annular peripheral wall surrounding a centerbody, and at least one swirler disposed between the centerbody and the peripheral wall, wherein the peripheral wall defines an inlet area of the corresponding premixer, and wherein intermediate passages are defined between adjacent ones of the two or more premixers; and a lip extending forward along the corresponding central axis from at least one of the peripheral walls, the lip extending at an oblique angle to the corresponding central axis.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
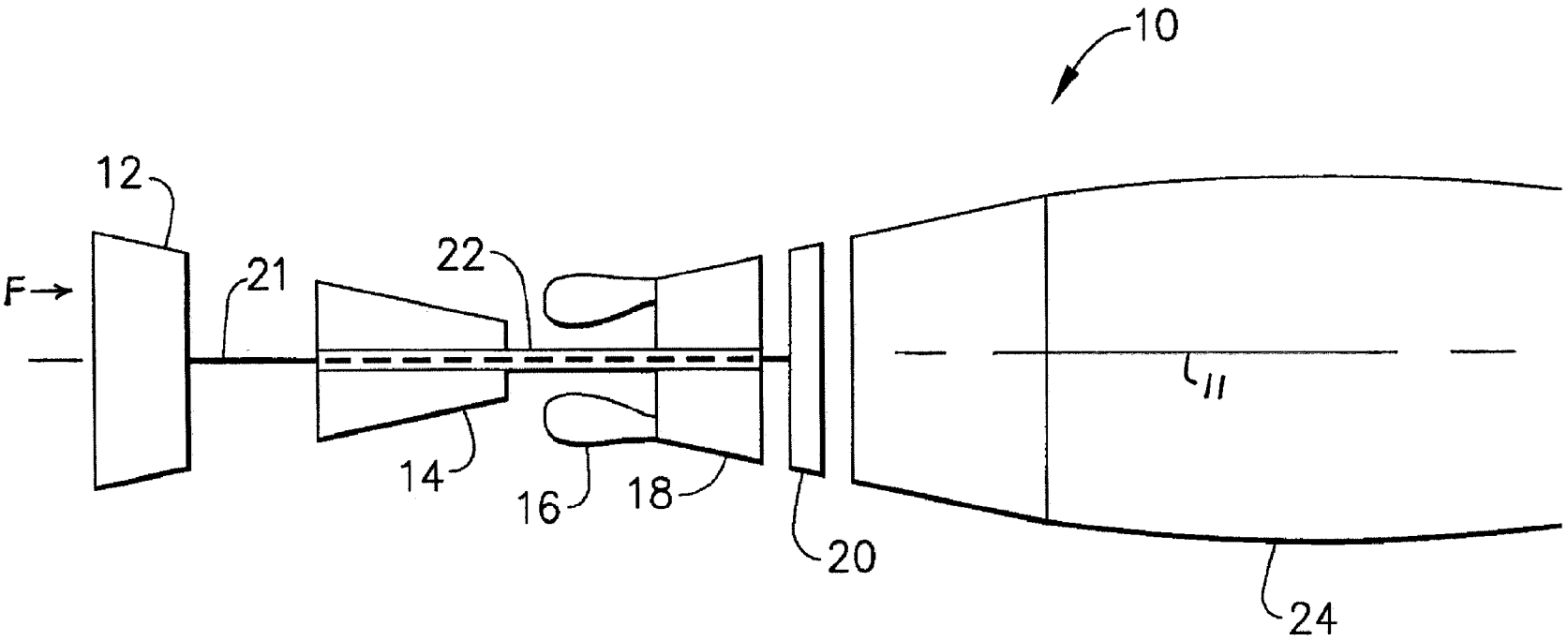
FIG. 1 (PRIOR ART)
FIG. 1 is a schematic illustration of a prior art gas turbine engine.

Referring to the drawings wherein identical reference numerals denote the same elements throughout the various views, FIG. 1 is a schematic illustration of a gas turbine engine 10 including a low-pressure compressor 12, a high-pressure compressor 14, and a combustor 16. Engine 10 also includes a high-pressure turbine 18 and a low-pressure turbine 20. Compressor 12 and turbine 20 are coupled by a first shaft 21, and compressor 14 and turbine 18 are coupled by a second shaft 22. A load (not shown) is also coupled to gas turbine engine 10 with first shaft 21. First and second shafts 21, 22 are disposed coaxially about a centerline axis 11 of the engine 10.

It is noted that, as used herein, the terms "axial" and "longitudinal" both refer to a direction parallel to the centerline axis 11, while "radial" refers to a direction perpendicular to the axial direction, and "tangential" or "circumferential" refers to a direction mutually perpendicular to the axial and radial directions. As used herein, the terms "forward" or "front" refer to a location relatively upstream in an air flow passing through or around a component, and the terms "aft" or "rear" refer to a location relatively downstream in an air flow passing through or around a component. The direction of this flow is shown by the arrow "F" in FIG. 1. These directional terms are used merely for convenience in description and do not require a particular orientation of the structures described thereby.

In operation, air flows through low pressure compressor 12 and compressed air is supplied from low pressure compressor 12 to high pressure compressor 14. The highly compressed air is delivered to combustor 16. Airflow from combustor 16 drives turbines 18 and 20 and exits gas turbine engine 10 through a nozzle 24.

Figure 2:
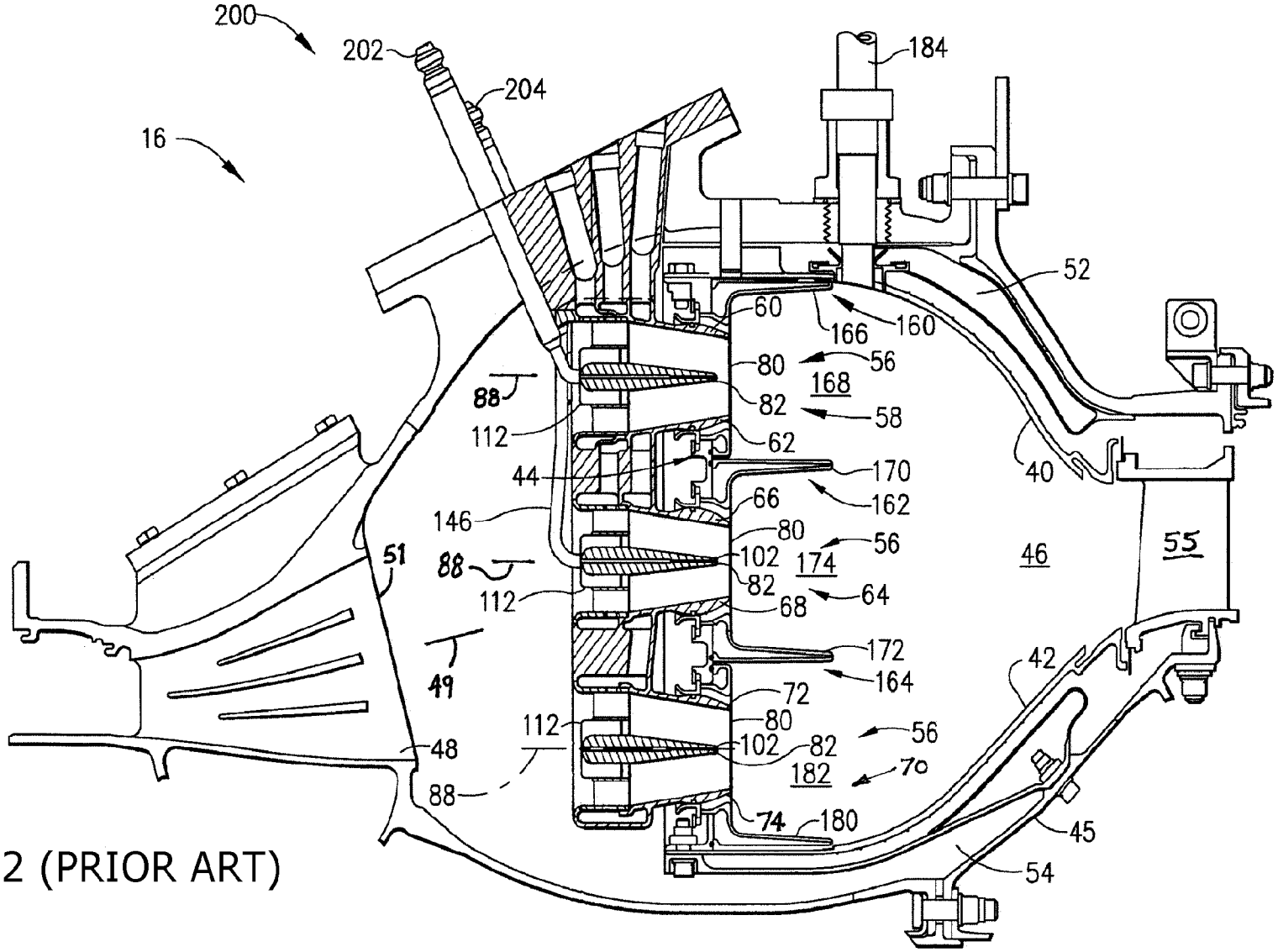
FIG. 2 (PRIOR ART)
FIG. 2 is a schematic, half-sectional view of a prior art combustor used with the gas turbine engine shown in FIG. 1.
Figure 3:
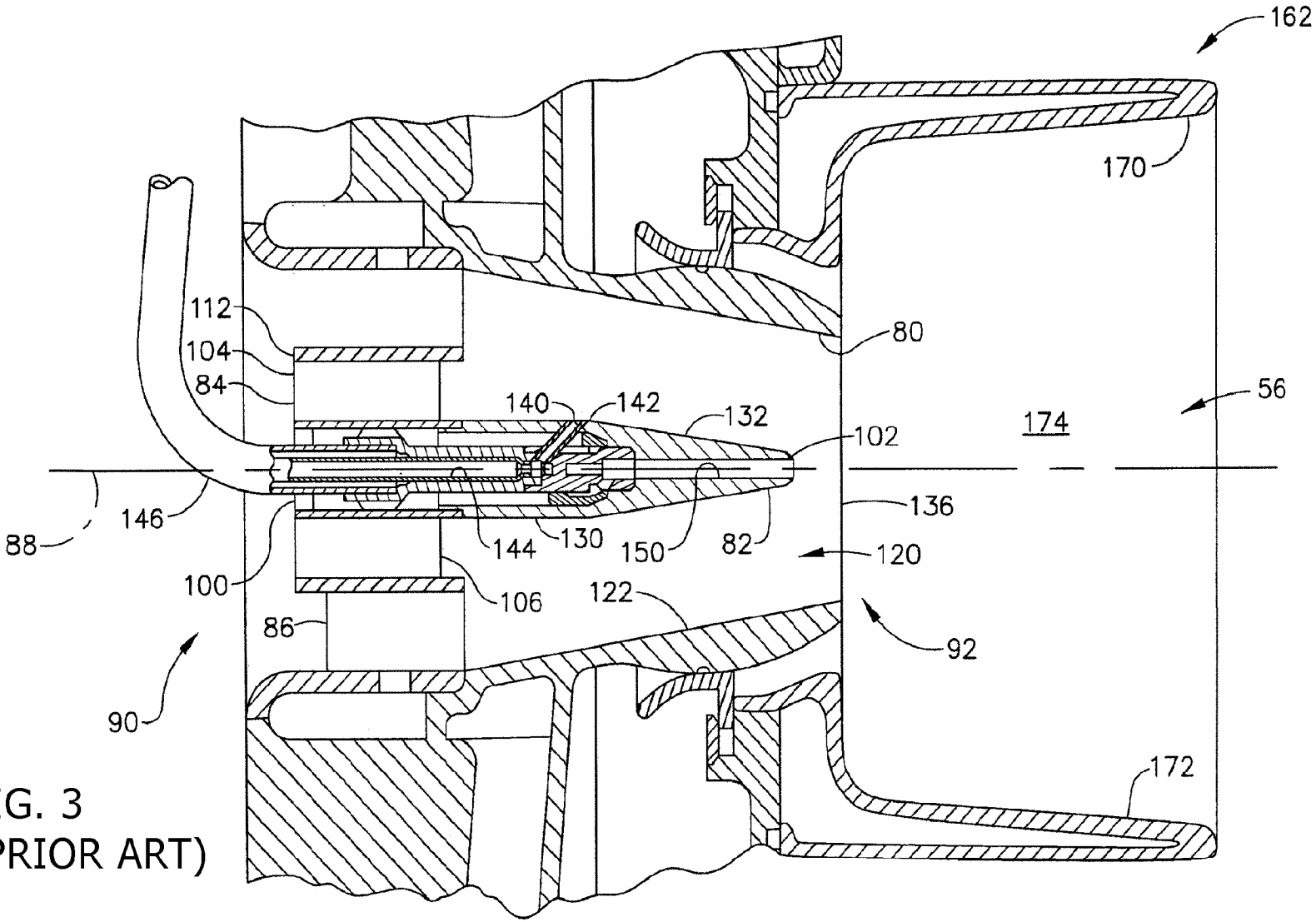
FIG. 3 (PRIOR ART)
FIG. 3 is an enlarged view of a portion of a premixer shown in FIG. 2.

FIGS. 2 and 3 are a cross-sectional view and an enlarged partial cross-sectional view, respectively, of combustor 16 used in gas turbine engine 10 (shown in FIG. 1). Because a fuel/air mixture supplied to combustor 16 contains more air than is required to fully combust the fuel, and because the air is mixed with the fuel prior to combustion, combustor 16 may be describe as a lean premix combustor. Accordingly, a fuel/air mixture equivalence ratio for combustor 16 may be less than one. Furthermore, because combustor 16 does not include water injection, combustor 16 is a dry low emissions combustor. Combustor 16 includes an annular outer liner 40, an annular inner liner 42, and a domed end 44 extending between outer and inner liners 40 and 42, respectively. Outer liner 40 and inner liner 42 are spaced radially inward from a combustor casing 45 and define a combustion chamber 46. Combustor casing 45 is generally annular and extends downstream from a diffuser 48. Viewed in half-section, the diffuser 48 has a diffuser axis 49 which extends through the midpoint of and normal to an exit plane 51 of the diffuser 48. Combustion chamber 46 is generally annular in shape and is disposed radially inward from liners 40 and 42. Outer liner 40 and combustor casing 45 define an outer passageway 52 and inner liner 42 and combustor casing 45 define an inner passageway 54. Outer and inner liners 40 and 42 extend to a turbine nozzle 55 disposed downstream from diffuser 48.

Combustor domed end 44 includes a plurality of domes 56 arranged in a triple annular configuration. Alternatively, combustor domed end 44 includes a double annular configuration. In another embodiment, combustor domed end 44 includes a single annular configuration. An outer dome 58 includes an outer end 60 fixedly attached to combustor outer liner 40 and an inner end 62 fixedly attached to a middle dome 64. Middle dome 64 includes an outer end 66 attached to outer dome inner end 62 and an inner end 68 attached to an inner dome 70. Accordingly, middle dome 64 is between outer and inner domes 58 and 70, respectively. Inner dome 70 includes an inner end 72 attached to middle dome inner end 68 and an outer end 74 fixedly attached to combustor inner liner 42.

Each dome 56 includes a plurality of premixer cups (interchangeably referred to herein as "premixers") 80 to permit uniform mixing of fuel and air therein and to channel the fuel/air mixture into combustion chamber 46. Each premixer cup 80 includes a centerbody 82, an inner swirler 84, an outer swirler 86, and an axis of symmetry 88 extending from an upstream side 90 of dome 56 to a downstream side 92 of dome 56. In one embodiment, inner swirler 84 and outer swirler 86 are counter-rotating. Each centerbody 82 is disposed co-axially with dome axis of symmetry 88 and includes a leading edge 100 and a trailing edge 102. In one embodiment, centerbody 82 is cast within premixer cup 80.

Each inner swirler 84 is secured to a centerbody 82 radially outward from centerbody 82 and includes a leading edge 104 and a trailing edge 106. Each outer swirler 86 is secured to an inner swirler 84 radially outward from inner swirler 84.

A hub 112 separates each inner swirler 84 from each outer swirler 86 and an annular mixing duct 120 is downstream from inner and outer swirlers 84 and 86, respectively. Mixing duct 120 is annular and is defined by an annular wall 122. Annular mixing duct 120 tapers uniformly from dome upstream side 90 to dome downstream side 92 to increase flow velocities within mixing duct 120.

Centerbody 82 also includes a cylindrically-shaped first body portion 130 and a conical second body portion 132. Second body portion 132 extends downstream from first body portion 130.

Centerbody 82 is hollow and includes a first orifice 140 extending from an outer surface 142 of centerbody 82 to an inner passageway 144. First orifice 140 is disposed at a junction between centerbody first body portion 130 and centerbody second body portion 132. First orifice 140 is a fuel port used to supply fuel to premixer cup 80 and inner passageway 144. Orifice 140 is in flow communication with a fuel nozzle 146 positioned at centerbody leading edge 100.

A plurality of second passageways 150 extend through centerbody 82 and are in flow communication with an air source (not shown). Passageways 150 permit small amounts of air to be supplied to combustor 16 to prevent wake separation adjacent centerbody 82.

Combustor domed end 44 also includes an outer dome heat shield 160, a middle dome heat shield 162, and an inner dome heat shield 164 to insulate each respective dome 58, 64, and 70 from flames burning in combustion chamber 46. Outer dome heat shield 160 includes an annular endbody 166 to insulate combustor outer liner 40 from flames burning in an outer primary combustion zone 168. Middle dome heat shield 162 includes annular heat shield centerbodies 170 and 172 to segregate middle dome 64 from outer and inner domes 58 and 70, respectively. Middle dome heat shield centerbodies 170 and 172 are disposed radially outward from a middle primary combustion zone 174.

Inner dome heat shield 164 includes an annular endbody 180 to insulate combustor inner liner 42 from flames burning in an inner primary combustion zone 182. An igniter 184 extends through combustor casing 45 and is disposed downstream from outer dome heat shield endbody 166.

Domes 58, 64, and 70 are supplied fuel and air via a premixer and assembly manifold system (not shown). A plurality of fuel tubes 200 extend between a fuel source (not shown) and domes 56. Specifically, an outer dome fuel tube 202 supplies fuel to premixer cup 80 disposed within outer dome 58, a middle dome fuel tube 204 supplies fuel to premixer cup 80 disposed within middle dome 64, and an inner dome fuel tube (not shown) supplies fuel to premixer cup 80 disposed within inner dome 70.

During operation of gas turbine engine 10, air and fuel are mixed in premixer cups 80 prior to the fuel/air mixture exiting dome 56 and entering combustion chamber 46.

As seen in FIG. 3, the domed end 44 is offset from the diffuser 48 in the radial direction. More specifically, the diffuser axis 49 is not coincident with the axis of symmetry 88 of the middle premixer 80 (or in fact, any of the premixers 80). Furthermore, the diffuser axis 49 is not parallel to the axis of symmetry 88 of any of the premixers 80. In practice, this offset relationship in combination with the conventionally-shaped blunt inlet lips of the premixers 80 has a tendency to cause improper flow feed of air exiting the diffuser 48 to the premixers 80, resulting in undesirable pressure losses and improper flow feed for the outer and inner passageways 52, 54.

Figure 4:
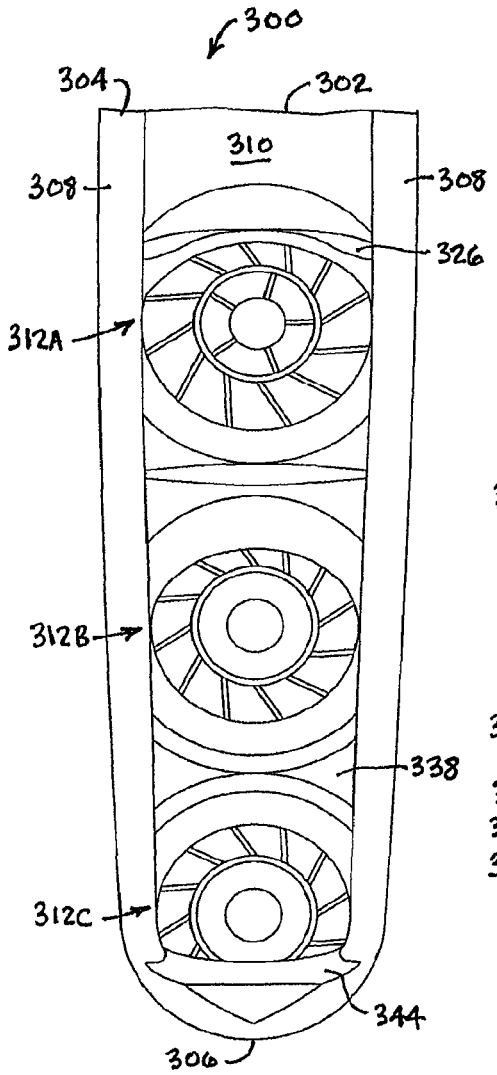
FIG. 4 is a front elevation view of a premixer assembly for use with the combustor shown in FIG. 1.
Figure 5:
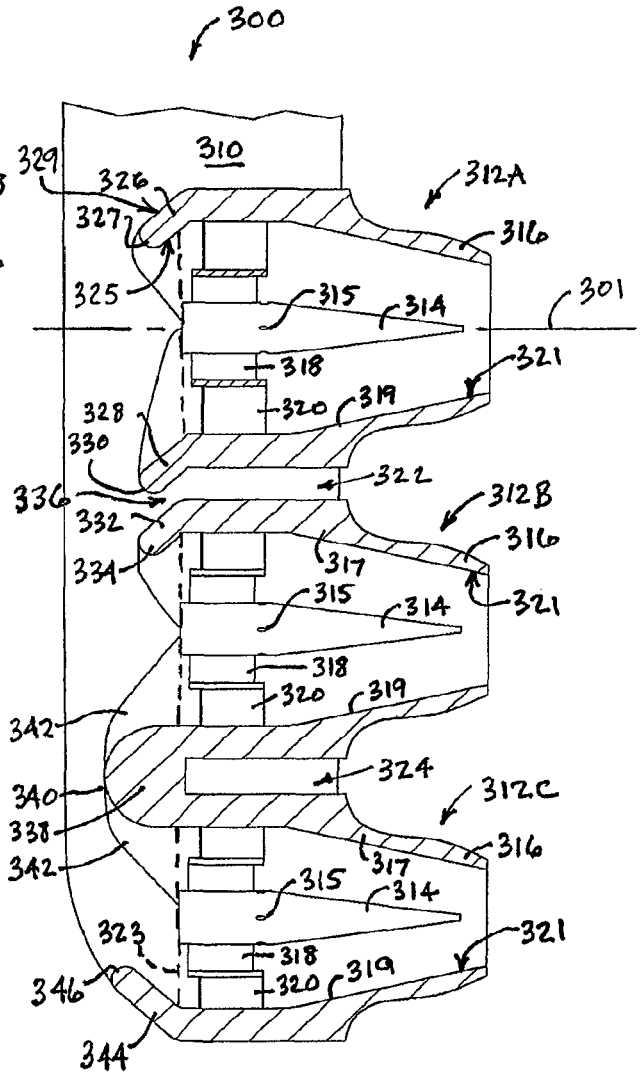
FIG. 5 is a side cross-sectional view of the premixer assembly of FIG. 4.

FIGS. 4 and 5 illustrate an embodiment of a premixer assembly 300 suitable for inclusion in a combustor such as the combustor 16 described above. The premixer assembly 300 includes features which improve the flow feed to individual premixers.

The premixer assembly 300 includes a stem 302 which extends in a radial direction from an outboard end 304 to an inboard end 306. The stem 302 includes a pair of laterally spaced-apart legs 308 which define an open flow space 310 therebetween. One or more premixers (denoted 312 generally) are disposed between the legs 308. In the illustrated example, there is an outer premixer 312A, a middle premixer 312B, and an inner premixer 312C. Each of the premixers 312A, B, C is generally similar in construction to the premixer 80 described above and includes a centerbody 314 including a fuel-discharging orifice 315 and positioned within a peripheral wall 316, an inner swirler 318, and an outer swirler 320. While the centerbody 314 as shown is configured to inject liquid fuel, the concepts described herein are also applicable to gas fuel or dual-fuel (i.e. liquid/gas) premixers. The centerbody 314 would be modified in accordance with known principles in order to inject gas fuels and/or dual fuels. For reference purposes, each peripheral wall 316 may be described as having an outboard wall portion 317 and an inboard wall portion 319. An inner surface 321 of the peripheral wall 316 defines the outer boundaries of an inlet flow area 323 adjacent an upstream inlet end of the premixer 321. Elements of the premixers 312A, B, C not specifically relevant to the present invention are omitted from FIGS. 4 and 5 for clarity. Elements of the premixers 312A, B, C not specifically described may be considered to be identical to the premixer 80 described above.

In practice, an annular array or a ring of premixer assemblies 300 would be provided for a combustor, such as combustor 16. When arranged in an annular array, the premixers 312A, B, C of the premixer assemblies 300 collectively define a ring of outer premixers 312A, a ring of middle premixers 312B, and a ring of inner premixers 312C.

The premixer assembly 300 includes an outboard intermediate passage 322 disposed between the outer premixer 312A and the middle premixer 312B, and an inboard intermediate passage 324 disposed between the middle premixer 312B and the inner premixer 312C.

At least one of the premixers 312A, B, C is provided with a lip extending from its forward end. The purpose of the lip is to capture and redirect airflow into the associated premixer 312A, B, C. As used herein, the term "lip" refers to a structure that extends at an oblique angle to a centerline axis of the premixer. In some embodiments, the lip extends at least partially into the projected frontal area of the inlet flow area 323. Stated another way, the lip of such an embodiment would block at least some portion of the inlet projected area when viewed in a forward-looking-aft orientation. Stated another way, a lip of such an embodiment extends at an oblique angle to the axis of symmetry so as to cross at least a portion of a forward projection of the inlet area of the corresponding premixer. In other embodiments, the lip extends away from a mixer centerline to define a bell mouth shape. Any of the lips described herein may be of varying axial lengths to suit a specific application. In general, the lips can function to guide the flow into the premixer they are disposed around or they can function to help guide flow to a radially adjacent mixer or combustor passage.

In the illustrated example, the outer premixer 312A has an outer premixer outboard lip 326 which extends forward along the premixer axis and radially inboard from the outer wall portion 317 of the outer premixer 312A. It has a convex leading edge 327. In front view (FIG. 4), its overall shape is curved in the same direction as the outer wall portion 317, i.e. convex radially outward relative to a central axis 301 of the outer premixer 312A. The premixer central axis 301 may be parallel to or oblique to the engine centerline 11. As a general statement, the surface of the lip facing towards the axis of the individual premixer (i.e. the lip's inner surface, labeled 325) may be curved in the same direction as the wall of the individual premixer. The opposite surface (i.e. the lip's outer surface, labeled 329) could be curved about the premixer centerline or another centerline such as the engine axial centerline 11. The lip's outer surface may be concave, straight, or convex relative to the axial centerline of the individual premixer. This shaping may be applied to any of the lips on any of the premixers described herein.

The outer premixer 312A further includes an outer premixer inboard lip 328 which extends forward along the premixer axis and radially inboard from the inner wall portion 319 of the outer premixer 312A. It has a convex leading edge 330.

The middle premixer 312B includes a middle premixer outboard lip 332 which extends forward along the premixer axis and radially inboard from the outer wall portion 317 of the middle premixer 312B. It has a convex leading edge 334. As seen in FIG. 5, the outer premixer inboard lip 328 can extend generally parallel to the middle premixer outboard lip 332, or it can extend at a different angle. A passage 336 extends between the outer premixer inboard lip 328 and the middle premixer outboard lip 332, communicating with the outboard intermediate passage 332.

A middle premixer-inner premixer fairing 338 interconnects the inner wall portion 319 of the middle premixer 312B and the outer wall portion 317 of the inner premixer 312C. It has a convex leading edge 340 and tapered transition portions 342 which are curved in the same direction as the inner and outer wall portions for the respective premixers.

Finally, an inner premixer inboard lip 344 extends forward along the premixer axis and radially outboard from the inner wall portion 319 of the inner premixer 312C. It has a convex leading edge 346. In side view (FIG. 5), it is curved radially outboard. In front view (FIG. 4), it is shown as being curved in the same direction as the inner wall portion 319, i.e. concave radially outward, but it could have an alternative shape as described above.

Figure 6:
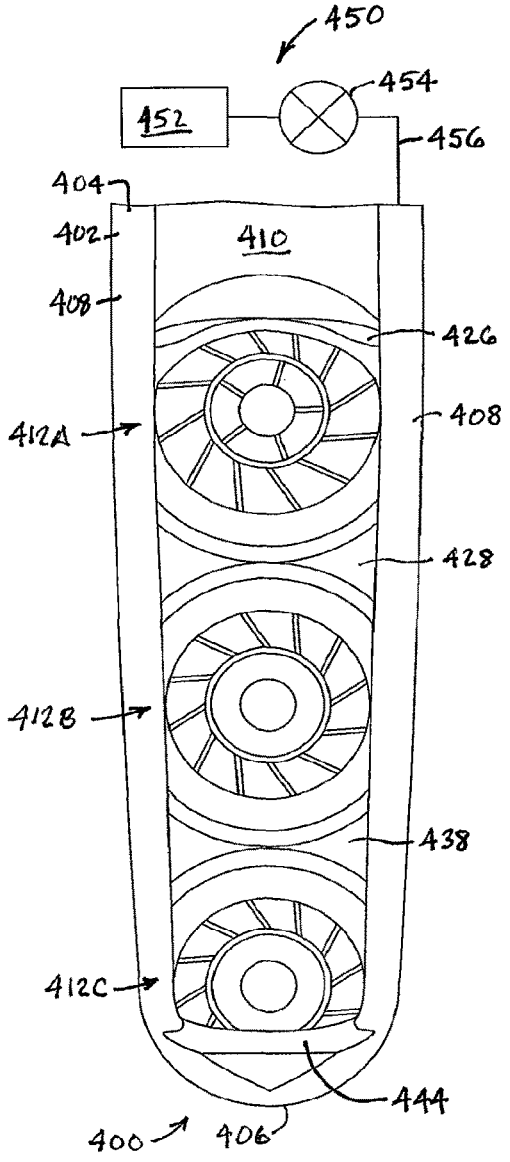
FIG. 6 is a front elevation view of an alternative premixer assembly for use with the combustor shown in FIG. 1.
Figure 7:
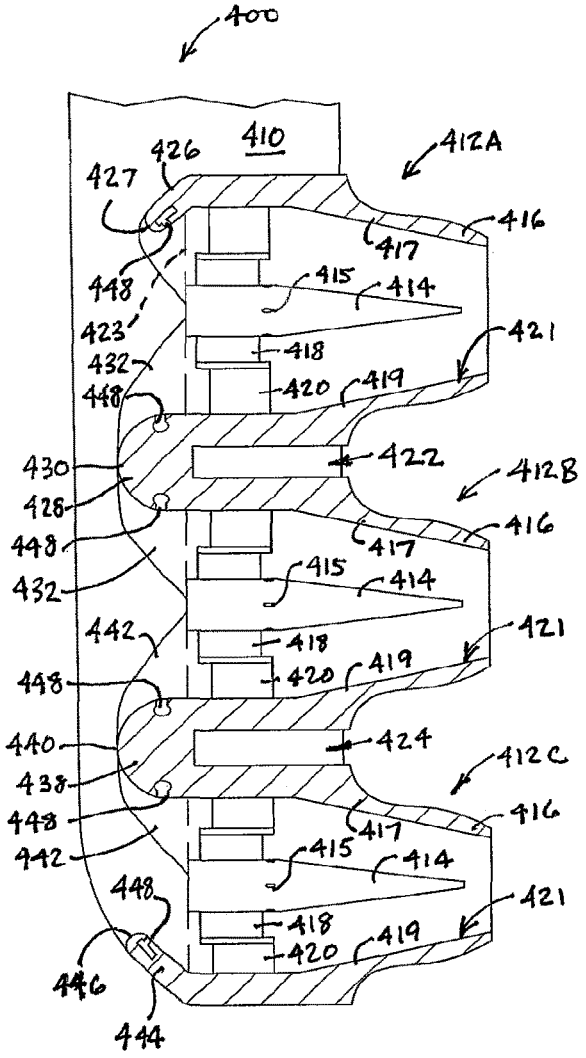
FIG. 7 is a side cross-sectional view of the premixer assembly of FIG. 6.

FIGS. 6 and 7 illustrate an alternative embodiment of a premixer assembly 400 suitable for inclusion in a combustor such as the combustor 16 described above.

The premixer assembly 400 includes a stem 402 which extends in a radial direction from an outboard end 404 and an inboard end 406. The stem 402 includes a pair of laterally spaced-apart legs 408 which define an open flow space 410 therebetween. One or more premixers (denoted 412 generally) are disposed between the legs 408. In the illustrated example, there is an outer premixer 412A, a middle premixer 412B, and an inner premixer 412C. Each of the premixers 412A, B, C is generally similar in construction to the premixer 80 described above and includes a centerbody 414 including a fuel-discharging orifice 415 and positioned within a peripheral wall 416, an inner swirler 418, and an outer swirler 420. While the centerbody 414 as shown is configured to inject liquid fuel, the concepts described herein are also applicable to gas fuel or dual-fuel (i.e. liquid/gas) premixers. The centerbody 414 would be modified in accordance with known principles in order to inject gas fuels and/or dual fuels. For reference purposes, each peripheral wall 416 may be described as having an outboard wall portion 417 and an inboard wall portion 419. An inner surface 421 of the peripheral wall 416 defines the outer boundaries of an inlet flow area 423 adjacent an upstream inlet end of the premixer 421. Elements of the premixers 412A, B, C not specifically relevant to the present invention are omitted from FIGS. 6 and 7 for clarity. Elements of the premixers 412A, B, C not specifically described may be considered to be identical to the premixer 80 described above.

In practice, an annular array or a ring of premixer assemblies 400 would be provided for a combustor, such as combustor 16. When arranged in an annular array, the premixers 412A, B, C of the premixer assemblies 400 collectively define a ring of outer premixers 412A, a ring of middle premixers 412B, and a ring of inner premixers 412C.

The premixer assembly 400 includes an outboard intermediate passage 422 disposed between the outer premixer 412A and the middle premixer 412B, and an inboard intermediate passage 424 disposed between the middle premixer 412B and the inner premixer 412C.

At least one of the premixers 412A, B, C is provided with a lip extending from its forward end.

In the illustrated example, the outer premixer 412A has an outer premixer outboard lip 426 which extends forward along the premixer axis and radially inboard from the outer wall portion 417 of the outer premixer 412A. It has a convex leading edge 427. In front view (FIG. 6), it is curved in the same direction as the outer wall portion 417, i.e. convex radially outward.

An outer premixer-middle premixer fairing 428 interconnects the inner wall portion 419 of the outer premixer 412A and the outer wall portion 417 of the middle premixer 412B. It has a convex leading edge 430 and tapered transition portions 432 which are curved in the same direction as the inner and outer wall portions for the respective premixers.

A middle premixer-inner premixer fairing 438 interconnects the inner wall portion 419 of the middle premixer 412B and the outer wall portion 417 of the inner premixer 412C. It has a convex leading edge 440 and tapered transition portions 442 which are curved in the same direction as the inner and outer wall portions for the respective premixers.

Finally, an inner premixer inboard lip 444 extends forward along the premixer axis and radially outboard from the inner wall portion 419 of the inner premixer 412C. It has a convex leading edge 446. In side view (FIG. 7), it is curved radially outboard. In front view (FIG. 6), it is shown as being curved in the same direction as the inner wall portion 419, i.e. concave radially outward, but it could have an alternative shape as described above.

Optionally, the premixer assembly 400 may be modified by the incorporation of additional injection points at the inlet of each premixer 412. In the example illustrated in FIG. 7, one or more injection holes 448 are provided at inlet-adjacent locations such as the outer premixer outboard lip 426, the outer premixer-middle premixer fairing 428, the middle premixer-inner premixer fairing 438, or the inner premixer inboard lip 444. The injection holes 448 may be coupled in fluid communication with a source of a secondary fluid such as gaseous fuel or steam. Appropriate equipment such as tanks, manifolds, piping, valves, and pumps may be provided for this purpose.

A secondary fluid system is shown schematically at 450 including a fluid supply 452, control valve 454, and supply piping 456. It will be understood that a fluid flowpath may be provided between the supply piping 456 and the additional injection holes 448 which passes through the premixer assembly 400. For example, internal passages may be provided in the stem legs 408 and premixers 412. Each injection hole 448 is shown communicating with a gallery forming a portion of an internal flowpath. The injection holes 448 may be coupled to independently-controllable circuits, such as one circuit for each premixer 412. In some embodiments, the secondary fluid system 450 may be a part of an existing engine system such as a fuel delivery and metering system.

The secondary fluid injected through the injection holes 448 may be used for different purposes. For example, steam may be injected from the injection holes 448 for the purpose of power augmentation. Alternatively, fuel injected from the injection holes 448 may provide for combustion dynamic suppression. For example, a relatively small amount of gaseous fuel (e.g. less than 20% about of total premixer flow) discharged through the injection holes 448 upstream of the swirlers may be effective to smear out the fuel-air premixing, reducing equivalence ratio waves which can drive unsteady heat-release that can couple with chamber/combustion acoustics, driving dynamics.

Figure 8:
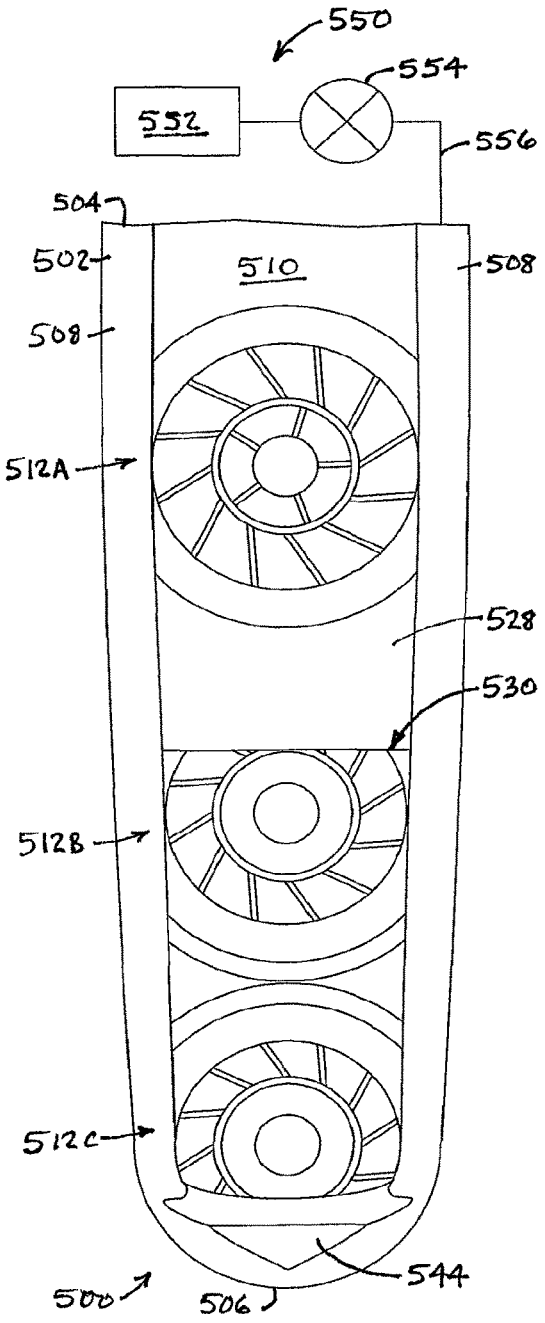
FIG. 8 is a front elevation view of an alternative premixer assembly for use of the combustor shown in FIG. 1.
Figure 9:
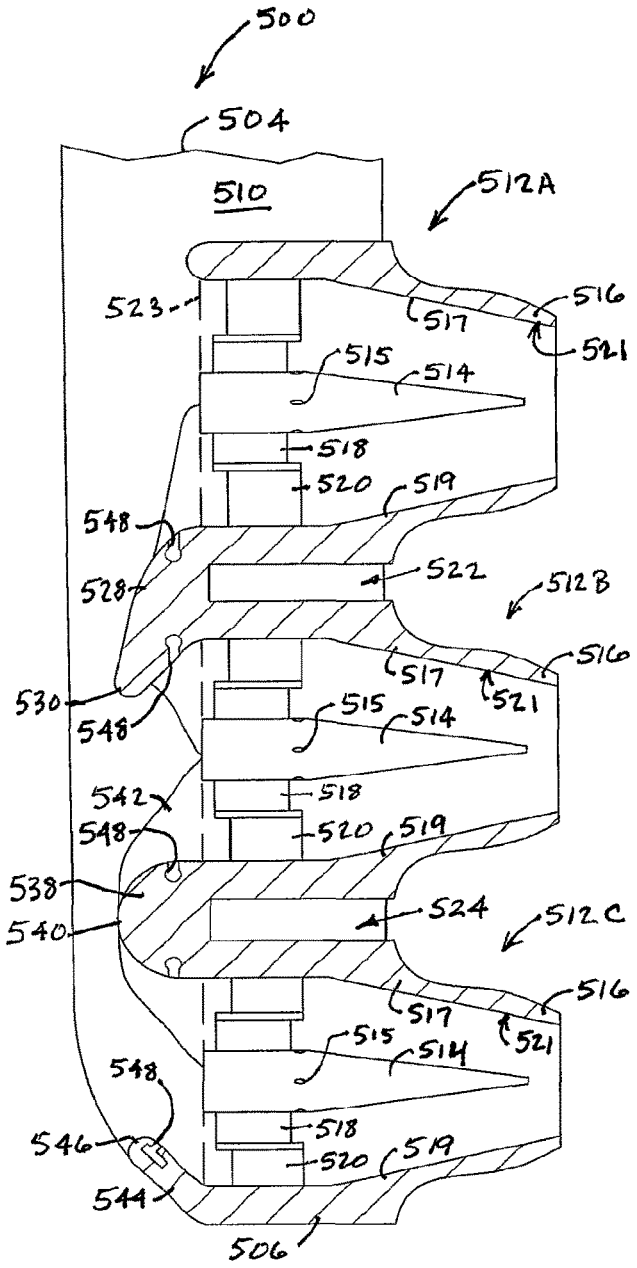
FIG. 9 is a side cross-sectional view of the premixer assembly of FIG. 8.

FIGS. 8 and 9 illustrate an alternative embodiment of a premixer assembly 500 suitable for inclusion in a combustor such as the combustor 16 described above.

The premixer assembly 500 includes a stem 502 which extends in a radial direction from an outboard end 504 and an inboard end 506. The stem 502 includes a pair of laterally spaced-apart legs 508 which define an open flow space 510 therebetween. One or more premixers (denoted 512 generally) are disposed between the legs 508. In the illustrated example, there is an outer premixer 512A, a middle premixer 512B, and an inner premixer 512C. Each of the premixers 512A, B, C is generally similar in construction to the premixer 80 described above and includes a centerbody 514 including a fuel-discharging orifice 515 and positioned within a peripheral wall 516, an inner swirler 518, and an outer swirler 520. While the centerbody 514 as shown is configured to inject liquid fuel, the concepts described herein are also applicable to gas fuel or dual-fuel (i.e. liquid/gas) premixers. The centerbody 514 would be modified in accordance with known principles in order to inject gas fuels and/or dual fuels. For reference purposes, each peripheral wall 516 may be described as having an outboard wall portion 517 and an inboard wall portion 519. An inner surface 524 of the peripheral wall 516 defines the outer boundaries of an inlet flow area 523 adjacent an upstream inlet end of the premixer 512. Elements of the premixers 512A, B, C not specifically relevant to the present invention are omitted from FIGS. 8 and 9 for clarity. Elements of the premixers 512A, B, C not specifically described may be considered to be identical to the premixer 80 described above.

In practice, an annular array or a ring of premixer assemblies 500 would be provided for a combustor, such as combustor 16. When arranged in an annular array, the premixers 512A, B, C of the premixer assemblies 500 collectively define a ring of outer premixers 512A, a ring of middle premixers 512B, and a ring of inner premixers 512C.

The premixer assembly 500 includes an outboard intermediate passage 522 disposed between the outer premixer 512A and the middle premixer 512B, and an inboard intermediate passage 524 disposed between the middle premixer 512B and the inner premixer 512C.

At least one of the premixers 512A, B, C is provided with a lip extending from its forward end.

In the illustrated example, an outer premixer-middle premixer fairing 528 interconnects the inner wall portion 519 of the outer premixer 512A and the outer wall portion 517 of the middle premixer 512B. It has a convex leading edge 530. It is tapered in thickness from aft to forward, with the smallest thickness being at the leading edge 530. The fairing 528 is asymmetric with respect to the premixer axis. In front view (FIG. 8), the leading edge 530 is shown as being substantially straight across, but it could have an alternative shape as described above.

A middle premixer-inner premixer fairing 538 interconnects the inner wall portion 519 of the middle premixer 512B and the outer wall portion 517 of the inner premixer 512C. It has a convex leading edge 540 and tapered transition portions 542 which are curved in the same direction as the inner and outer wall portions for the respective premixers.

Finally, an inner premixer inboard lip 544 extends forward along the premixer axis and radially outboard from the inner wall portion 519 of the inner premixer 512C. It has a convex leading edge 546. In side view (FIG. 9), it is curved radially outboard. In front view (FIG. 8), it is shown as being curved in the same direction as the inner wall portion 519, i.e. concave radially outward, but it could have an alternative shape as described above.

Optionally, the premixer assembly 500 may be modified by the incorporation of additional injection points at the inlet of each premixer 512. In the example illustrated in FIG. 8, one or more injection holes 548 are provided at inlet-adjacent locations such as the outer premixer-middle premixer fairing 528, the middle premixer-inner premixer fairing 538, or the inner premixer inboard lip 544. The injection holes 548 may be coupled in fluid communication with a source of a secondary fluid such as gaseous fuel or steam. Appropriate equipment such as tanks, manifolds, piping, valves, and pumps may be provided for this purpose.

A secondary fluid system is shown schematically at 550 including a fluid supply 552, control valve 554, and supply piping 556. It will be understood that a fluid flowpath may be provided between the supply piping 556 and the injection holes 548 which passes through the premixer assembly 500. For example, internal passages may be provided in the stem legs 508 and premixers 512. Each injection hole 548 is shown communicating with a gallery forming a portion of an internal flowpath. The injection holes 548 may be coupled to independently-controllable circuits, such as one circuit for each premixer 512. In some embodiments, the secondary fluid system 550 may be a part of an existing engine system such as a fuel delivery and metering system. Operation may be as described above for secondary fluid system 450 and injection holes 448.

The premixer apparatus described herein has advantages over the prior art. It will reduce overall combustion system pressure loss. It improves back flow margin to downstream components (e.g., nozzles, turbines)

It will improve flow uniformity to premixers enabling them to perform more efficiently and reduce the risk of flame-holding or flashback because there is less vane-to-vane flow variation.

Improved premixer inlet pressure recovery can enable more flow for a given mixer size or allow for a smaller mixer to be used to achieve the same flow This will lead to improved engine performance due to lower pressure loss, improved component durability due to higher back flow margins, improved premixer durability due to higher potential mixer pressure differential. Improved combustion system fuel flexibility due to higher potential mixer pressure differential and flow uniformity.

The foregoing has described a premixer assembly for a combustor. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A premixer assembly for a combustor having a centerline axis, the premixer assembly extending in a radial direction from an outboard end to an inboard end with respect to the centerline axis, comprising:

a ring of outer premixers and a ring of inner premixers, each of the outer premixers and each of the inner premixers having:

a central axis;

a peripheral wall surrounding a centerbody, the peripheral wall having an inner wall portion and an outer wall portion with respect to the centerline axis and defining an inlet area of the premixer; and at least one swirler disposed between the centerbody and the peripheral wall, wherein each outer premixer of the ring of outer premixers has an outer premixer outboard lip extending forward along the central axis and radially inboard from the respective outer wall portion, and wherein each inner premixer of the ring of inner premixers has an inner premixer inboard lip extending forward along the central axis and radially outboard from the respective inner wall portion.

2. The premixer assembly of claim 1, wherein the outer premixer outboard lip has a convex leading edge and an overall shape that is curved in the same direction as the respective outer wall portion.

3. The premixer assembly of claim 1, wherein the outer premixer outboard lip is convexly curved radially outward relative to the respective central axis.

4. The premixer assembly of claim 1, wherein each outer premixer of the ring of outer premixers has an outer premixer inboard lip.

5. The premixer assembly of claim 4, wherein the outer premixer inboard lip extends forward along the central axis and radially inboard from the respective inner wall portion.

6. The premixer assembly of claim 4, wherein the outer premixer inboard lip has a convex leading edge.

7. The premixer assembly of claim 1, further comprising a ring of middle premixers located between the ring of outer premixers and the ring of inner premixers, each of the middle premixers having:

a central axis;

a peripheral wall surrounding a centerbody, the peripheral wall having an inner wall portion and an outer wall portion with respect to the centerline axis and defining an inlet area of the premixer; and at least one swirler disposed between the centerbody and the peripheral wall.

8. The premixer assembly of claim 7, wherein each middle premixer of the ring of middle premixers comprises a middle premixer outboard lip which extends forward along the central axis.

9. The premixer assembly of claim 8, wherein the middle premixer outboard lip has a convex leading edge.

10. The premixer assembly of claim 8, wherein each outer premixer of the ring of outer premixers has an outer premixer inboard lip, and wherein the outer premixer inboard lip extends parallel to the respective middle premixer outboard lip.

11. The premixer assembly of claim 10, further comprising a passage extending between the outer premixer inboard lip and the respective middle premixer outboard lip.

12. The premixer assembly of claim 7, wherein each of the middle premixers of the ring of middle premixers includes a fairing.

13. The premixer assembly of claim 12, wherein the fairing is a middle premixer-inner premixer fairing interconnecting the respective inner wall portion of the middle premixer and the respective outer wall portion of the respective inner premixer, the middle premixer-inner premixer fairing having a convex leading edge and tapered transition portions that are curved in the respective same direction as the respective inner wall portion of the middle premixer and the respective outer wall portion of the respective inner premixer.

14. The premixer assembly of claim 12, wherein the fairing is an outer premixer-middle premixer fairing interconnecting the respective inner wall portion of the respective outer premixer and the respective outer wall portion of the middle premixer, the outer premixer-middle premixer fairing having a convex leading edge and tapered transition portions that are curved in the respective same direction as the respective inner wall portion of the respective outer premixer and the respective outer wall portion of the middle premixer.

15. A combustor for a gas turbine engine having a centerline axis, comprising:

an annular inner liner;

an annular outer liner spaced apart from the inner liner;

a domed end disposed at an upstream end of the annular inner liner and the annular outer liner, the domed end including a ring of outer premixers with respect to the centerline axis and a ring of inner premixers with respect to the centerline axis, each of the outer premixers and each of the inner premixers having:

a central axis;

a peripheral wall surrounding a centerbody, the peripheral wall having an inner wall portion and an outer wall portion with respect to the centerline axis and defining an inlet area of the premixer; and at least one swirler disposed between the centerbody and the peripheral wall, wherein each outer premixer of the ring of outer premixers has an outer premixer outboard lip extending forward along the central axis and radially inboard with respect to the centerline axis from the respective outer wall portion, and wherein each inner premixer of the ring of inner premixers has an inner premixer inboard lip extending forward along the central axis and radially outboard with respect to the centerline axis from the respective inner wall portion.

16. The combustor of claim 15, wherein each outer premixer of the ring of outer premixers has an outer premixer inboard lip.

17. The combustor of claim 15, further comprising a ring of middle premixers located between the ring of outer premixers and the ring of inner premixers, each of the middle premixers having:

a central axis;

a peripheral wall surrounding a centerbody, the peripheral wall having an inner wall portion and an outer wall portion with respect to the centerline axis and defining an inlet area of the premixer; and at least one swirler disposed between the centerbody and the peripheral wall.

18. The combustor of claim 17, wherein each middle premixer of the ring of middle premixers comprises a middle premixer outboard lip which extends forward along the central axis.

19. The combustor of claim 18, wherein each outer premixer of the ring of outer premixers has an outer premixer inboard lip, and wherein a passage extends between the outer premixer inboard lip and the respective middle premixer outboard lip.

20. The combustor of claim 17, wherein each of the middle premixers of the ring of middle premixers includes a fairing.

* * * * *